US007644915B2

(12) United States Patent
Schwarzbauer et al.

(10) Patent No.: US 7,644,915 B2
(45) Date of Patent: Jan. 12, 2010

(54) DEVICE FOR THE WITHDRAWAL OF INDIVIDUAL FLAT MAIL FROM A THINNING SECTION

(75) Inventors: Michael Schwarzbauer, Constance (DE); Oliver Kutzer, Radolfzell (DE)

(73) Assignee: Siemens Aktiengesellschaft, Munich (DE)

( * ) Notice: Subject to any disclaimer, the term of this patent is extended or adjusted under 35 U.S.C. 154(b) by 524 days.

(21) Appl. No.: 11/658,531

(22) PCT Filed: Apr. 22, 2005

(86) PCT No.: PCT/EP2005/004376

§ 371 (c)(1), (2), (4) Date: Jan. 25, 2007

(87) PCT Pub. No.: WO2006/012927

PCT Pub. Date: Feb. 9, 2006

(65) Prior Publication Data

US 2009/0008863 A1 Jan. 8, 2009

(30) Foreign Application Priority Data

Jul. 30, 2004 (DE) ..... 10 2004 037 420

(51) Int. Cl.
*B65H 3/04* (2006.01)

(52) U.S. Cl. ..... 271/3.21; 271/3.2; 271/150

(58) Field of Classification Search ..... 271/3.2, 271/3.21, 149, 150

See application file for complete search history.

(56) References Cited

U.S. PATENT DOCUMENTS 3,372,925 A 3/1968 De Vries et al.
3,743,274 A * 7/1973 Komori ..... 271/3.2
3,894,732 A 7/1975 Mueller
4,909,499 A 3/1990 O'Brien et al.
4,978,114 A 12/1990 Holbrook
5,074,540 A 12/1991 Belec et al.
5,244,199 A * 9/1993 Wood ..... 271/150
5,249,788 A * 10/1993 Helmstadter ..... 271/10.07

(Continued)

FOREIGN PATENT DOCUMENTS

DE 26 13 261 10/1977

(Continued)

*Primary Examiner*—Patrick H Mackey
*Assistant Examiner*—Howard Sanders
(74) *Attorney, Agent, or Firm*—Laurence A. Greenberg; Werner H. Stemer; Ralph E. Locher

(57) ABSTRACT

A device for withdrawing flat items of mail from a decollating section includes conveyor belts, and guide rollers. The conveyor belts extend around guide rollers and act unilaterally upon upright items of mail. The guide rollers are individually mounted, and, at an exit of the decollating section, are rotatably disposed jointly with transfer rollers of an adjoining transfer region, which are driven independently of the conveyor belts on a common guide axle. On a side of the conveying path pressure rollers are provided at a level of the transfer rollers, which press the items against the transfer rollers. The pressure rollers are mounted pivotably at a locally fixed fulcrum, which is situated in withdrawal direction upstream thereof and laterally offset from a conveying channel, and in which rollers driven synchronously with the transfer rollers are rotatably mounted. Belts forming an inlet extend over the pressure rollers and the driven rollers.

3 Claims, 2 Drawing Sheets

U.S. PATENT DOCUMENTS

| | | | | |
|---|---|---|---|---|
| 6,003,857 | A | 12/1999 | Salomon et al. | |
| 6,173,950 | B1 * | 1/2001 | Bakoledis | 271/34 |
| 7,192,025 | B1 * | 3/2007 | Golicz et al. | 271/34 |

FOREIGN PATENT DOCUMENTS

| | | |
|---|---|---|
| EP | 0 060 596 B1 | 6/1985 |
| EP | 0 598 571 A1 | 5/1994 |

* cited by examiner

DEVICE FOR THE WITHDRAWAL OF INDIVIDUAL FLAT MAIL FROM A THINNING SECTION

BACKGROUND OF THE INVENTION

The invention relates to a device for the withdrawal of individual flat items of mail from a decollating section.

The flow of mail generated in the decollating section is mechanically gripped and carried along at high speed by rigid, driven transfer rollers and by pressure rollers disposed on the opposite side on a unilaterally spring-loaded rocker or by belts running over these rollers (DE 26 13 261 A1, U.S. Pat. Nos. 5,074,540, 6,003,857). In this case, a gap in the only unilaterally gripped items of mail is to be noted in the belt transfer to the transfer rollers. Short items of mail are therefore held only partially, which in an adverse situation may lead to conveying malfunctions and to rotation of and/or damage to items of mail. The items of mail are centred by means of guide elements relative to the transfer/pressure rollers. Thin items of mail run at a much more advantageous angle into the roller pair than thick items of mail. In the case of thick items of mail, their leading edges run at a disadvantageous angle into these transfer/pressure rollers and are squashed against the rollers.

From U.S. Pat. No. 3,372,925 a device is known, in which within a decollating section a guide roller of a conveyor belt is disposed together with transfer rollers on a guide axle. In this case, the conveyor belt and the transfer rollers are driven independently of one another by a single motor. After final decollation by means of a decollating roller, the items of mail at the exit of the decollating section are transferred to a transfer roller and a pressure roller of a transfer region adjoining the decollating section. In this case, the pressure roller, which is mounted pivotably at a locally fixed fulcrum situated laterally offset from the conveying channel, is pressed by the action of a spring towards the transfer roller. A pivotably mounted plate forms an inlet for the transfer region.

From U.S. Pat. No. 3,894,732 a device is known, in which at the exit of a decollating section guide-rollers of a conveyor belt and transfer rollers of a transfer region are jointly driven and disposed in a fixed manner on a common guide axle. On the opposite side of the conveying path at the level of the transfer rollers there are disposed on pivotable arms guide rollers, extending over which are belts that form an inlet of the transfer region.

From EP 0 060 596 B1 a device is known, in which at the exit of a decollating section a guide roller of a conveyor belt and a further guide roller of a further conveyor belt are disposed in a jointly driven manner on an axle. Disposed upstream of the exit of the decollating section are rollers, which are mounted opposite the conveyor belts on a pivotable frame and extending over which is a frame that forms an inlet. The belt forming the inlet and the rollers associated therewith are driven in the opposite direction to the conveying direction of the items of mail. From the exit of the decollating section the decollated items of mail are transferred to belts of a transfer region, which extend over transfer rollers.

SUMMARY OF THE INVENTION

The underlying object of the invention is to provide a device for the withdrawal of individual flat items of mail from a decollating section, in which device the transfer of the items of mail irrespective of the thickness thereof occurs in a substantially jolt-free manner and the items of mail irrespective of their length are fully guided at all times.

Accordingly, one aspect involves a device for withdrawing flat items of mail from a decollating section includes conveyor belts, and guide rollers. The conveyor belts extend around guide rollers and act unilaterally upon upright items of mail. The guide rollers are individually mounted, and, at an exit of the decollating section, are rotatably disposed jointly with transfer rollers of an adjoining transfer region, which are driven independently of the conveyor belts on a common guide axle. On a side of the conveying path pressure rollers are provided at a level of the transfer rollers, which press the items against the transfer rollers. The pressure rollers are mounted pivotably at a locally fixed fulcrum, which is situated in withdrawal direction upstream thereof and laterally offset from a conveying channel, and in which rollers driven synchronously with the transfer rollers are rotatably mounted. Belts forming an inlet extend over the pressure rollers and the driven rollers.

In this case, the individually mounted guide rollers of the conveyor belts at the exit of the decollating section are rotatably disposed together with transfer rollers of an adjoining transfer region, which are driven independently of the conveyor belts, on a common guide axle. On the opposite side of the conveying path there are provided at the level of the transfer rollers pressure rollers, which with spring force press the items of mail against the transfer rollers and are mounted pivotably at a locally fixed fulcrum, which is situated in withdrawal direction upstream thereof and laterally offset from the conveying channel and at which rollers driven synchronously with the transfer rollers are rotatably mounted. Belts forming an inlet extend over the pivotable pressure rollers and the driven rollers. Thus, by disposing the last guide rollers of the decollating section and the transfer rollers on a common guide axle, a gap in the transfer path of the unilaterally gripped items of mail is avoided. As the leading edges of the items of mail meet the belt forming the inlet always at the same angle, the conveying force is introduced in a manner that is gentle on the items of mail, irrespective of the thickness thereof.

Advantageous embodiments of the invention are outlined in the subclaims.

Thus, it is advantageous to dispose at right angles to the conveying direction, at the level of the guide axle of the transfer rollers, a sensor for detecting the leading and/or trailing edges of the items of mail, in order to use the detection signals to control the drives of the decollating section.

It is also advantageous to provide in the decollating section up to the transfer rollers a driven underfloor belt, on which the decollated, unilaterally gripped items of mail stand during conveying. Support is therefore provided for the conveying in particular of thick, heavy items of mail.

BRIEF DESCRIPTION OF THE SEVERAL VIEWS OF THE DRAWINGS

There now follows a description of an exemplary embodiment of the invention with reference to the drawings.

The drawings show

DETAILED DESCRIPTION OF THE INVENTION

Figure 1:
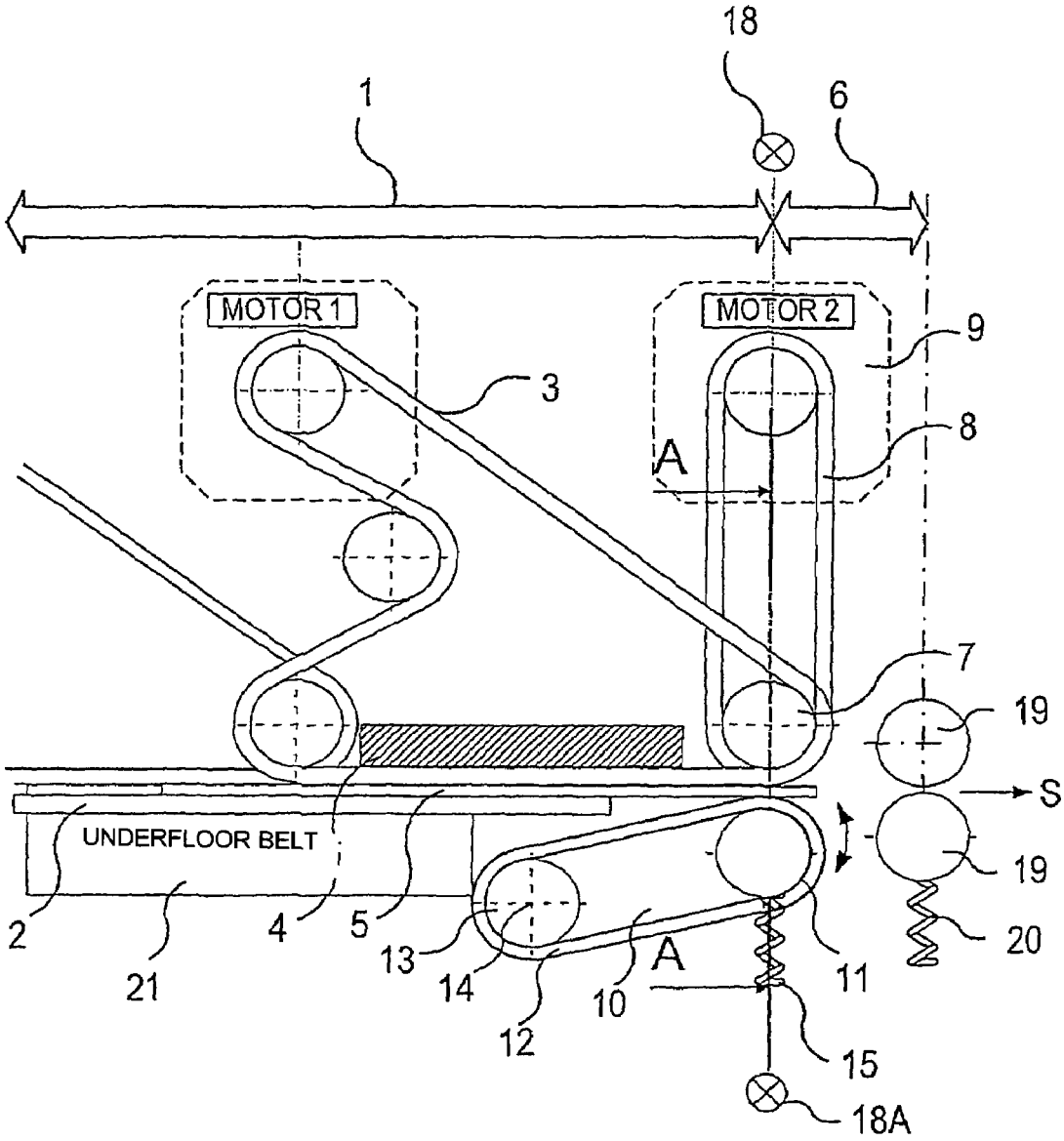
FIG. 1 a diagrammatic plan view of the withdrawal device.
Figure 2:
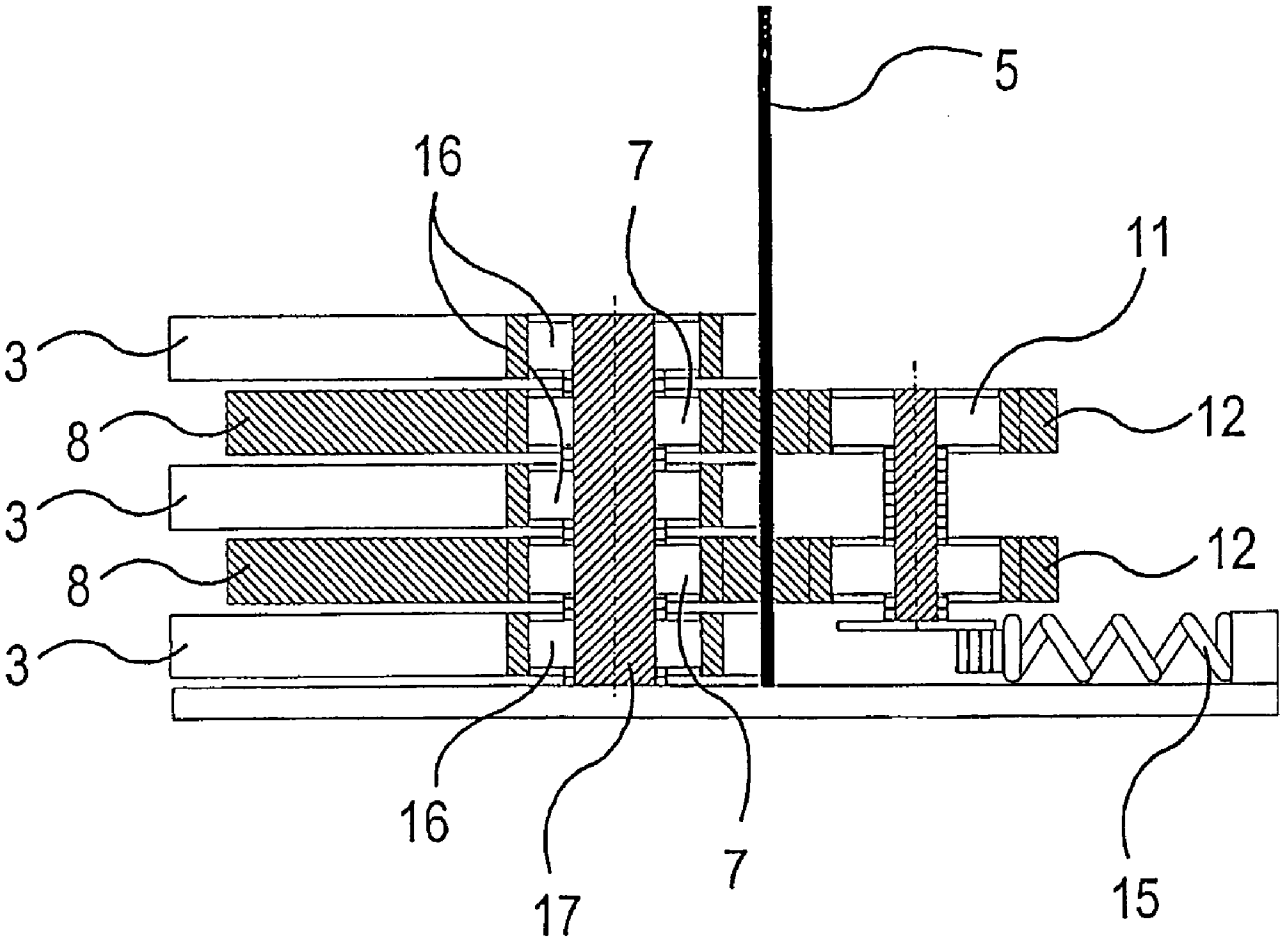
FIG. 2 a representation of the section A-A of FIG. 1.

The transition of the last conveying portion of the decollating section 1 to the transfer unit is to be realized without a conveying gap therebetween. The item of mail 5, which in the decollating section 1 is pressed by a retaining belt 2 against the rearmost conveyor belt 3 and is additionally applied by suction by means of the vacuum chamber 4, is conveyed in arrow direction S. Any multiple withdrawals clinging thereto are held back owing to the high coefficient of friction of the retaining belt 2. To support conveying of the items of mail 5 in the decollating section 1, they stand on a driven underfloor belt 21. In the present example, the transfer region 6 disposed at the end of the decollating section 1 comprises transfer rollers 7 with driving belts 8 and associated motor 9 as well as a spring-loaded belt rocker 10 with pressure rollers 11 and rocker belts 12. The rocker fulcrum 14 in this case lies in the drive axis of the rollers 13, which are driven synchronously with the transfer rollers 7, for the rocker belts 12. The pressure rollers 11 are pressed by a pressure spring 15 against the driving belts 8 on the transfer rollers 7. The individually mounted guide rollers 16 of the conveyor belts 3 from the decollating section and the transfer rollers 7 from the transfer region 6 are mounted at the transfer point on a common guide axle 17. The conveyor belts 3 of the decollating section 1 at the transfer point alternate vertically with the driving belts 8 from the transfer region 6. The common guide axle 17 of the last guide rollers 16 of the decollating section 1 and of the transfer rollers 7 allows an absolutely gap-free conveying transition. The running of the leading edges of the items of mail into the belt rocker 10, i.e. the contact with the rocker belts 12 occurs always at the same angle, irrespective of the thickness of the item of mail. If the rocker fulcrum 14 is disposed relatively close to the conveying path, i.e. the run-in angle of the rocker 10 relative to the conveying path is small, no unacceptable impact loading of the mail items of differing thickness occurs. After the leading edge of an item of mail has obscured a light barrier 18/18*a* at the transfer point, the drive motor of the conveyor belts 3 of the decollating section 1, if need be, may be switched off. From this moment on, the item of mail 5 is withdrawn by the transfer unit comprising the transfer and pressure rollers 7, 11 against the stationary conveyor belts 3 of the decollating section 1. Any double withdrawals clinging to the item of mail 5 are additionally separated in this start-stop mode. A short distance downstream of the transfer point a cover-band conveying system for onward conveying of the items of mail is disposed, of which the first guide rollers 19 are illustrated. For adaptation to the different thicknesses of the items of mail, one of the two guide rollers 19 is deflectable against a pressure spring 20. As the items of mail 5 are gripped securely both between the transfer and pressure rollers 7, 11 and between the guide rollers 19 of the cover-band conveying system, the slight gap therebetween in the conveying path has no adverse effects.

The invention claimed is:

1. A device for withdrawing individual flat items of mail from a decollating section, comprising:

driven conveyor belts, guide rollers, wherein the conveyor belts extend around the guide rollers and act unilaterally upon upright items of mail, wherein the guide rollers of the conveyor belts are individually mounted, and, at an exit of the decollating section, are rotatably disposed jointly with transfer rollers of an adjoining transfer region, which are driven independently of the conveyor belts on a common guide axle, on a side of the conveying path there are provided at a level of the transfer rollers pressure rollers, which press the items of mail against the transfer rollers, the pressure rollers are mounted pivotably at a locally fixed fulcrum, which is situated in withdrawal direction upstream thereof and laterally offset from conveying channel, and in which rollers driven synchronously with the transfer rollers are rotatably mounted, and belts forming an inlet extend over the pivotable pressure rollers and the driven rollers.

2. The device according to claim 1, wherein a sensor for detecting at least one of leading and trailing edges of the items of mail is disposed at right angles to the conveying direction at the level of the guide axle of the transfer rollers is.

3. The device according to claim 1, wherein a driven underfloor belt is provided in the decollating section up to the transfer rollers, and wherein the decollated items of mail stand on the underfloor belt during conveying.

* * * * *